United States Patent [19]

Saliba et al.

[11] 4,124,138

[45] Nov. 7, 1978

[54] PROTECTIVE DEVICE

[76] Inventors: William Saliba, 4206 Skipper Rd., Apt. 80, Tampa, Fla. 33602; Juliana M. Hoefling, 9712½ N. 14th St., Tampa, Fla. 33612

[21] Appl. No.: 822,701

[22] Filed: Aug. 8, 1977

[51] Int. Cl.[2] ..... A47G 19/22; A61J 7/00; B65D 41/32

[52] U.S. Cl. ..... 220/90.2; 128/222; 220/90.6; 220/270; 229/7 R

[58] Field of Search ..... 220/90.2, 90.4, 90.6, 220/270; 128/222; 229/7 R, 43; 215/100.5

[56] References Cited

U.S. PATENT DOCUMENTS

| | | | |
|---|---|---|---|
| 34,311 | 4/1901 | Mier | 220/90.4 |
| 110,148 | 12/1870 | Leach | 220/90.2 |
| 440,541 | 11/1890 | Chandler | 220/90.2 |
| 442,698 | 12/1890 | Yates | 128/222 |
| 2,656,837 | 10/1953 | Bryan | 128/222 |
| 2,693,685 | 11/1954 | Stafford | 220/90.6 |
| 2,940,447 | 6/1960 | Zanegood | 128/222 |
| 3,777,968 | 12/1973 | Law | 229/7 R |
| 3,800,999 | 4/1974 | Serritella | 220/90.4 |
| 3,868,043 | 2/1975 | Freemyer | 220/90.4 |

FOREIGN PATENT DOCUMENTS

| | | | |
|---|---|---|---|
| 1,859 of | 1864 | United Kingdom | 220/90.2 |
| 1,380 of | 1896 | United Kingdom | 220/90.2 |

*Primary Examiner*—William Price
*Assistant Examiner*—Allen N. Shoap
*Attorney, Agent, or Firm*—Stein & Frijouf

[57] ABSTRACT

A protective device for use with a drinking container is disclosed for protecting a person while drinking from the container. The protective device may be used as a moustache protective device or may be used for preventing ice within the liquid container from contacting the upper lip of the person drinking from the container. The device includes a shield having an aperture with tabs extending from opposed sides of the shield. The tabs are established for contacting the outer circumference of the drinking container when the shield is positioned over the opening. The aperture provides control liquid flow from the drinking container to the person. Resilient means including a first and a second resilient arm grasp the outer circumference of the drinking container for retaining the shield to the container. The device may be an integral plastic member with the first and second arms being resilient within limited excursions of deformation while being simultaneously deformable when subjected to excursions beyond the limited excursions. Accordingly, the integral plastic member may be adjustable for resiliently grasping liquid containers of various sizes. An optional cartridge may be included for introducing a substance such as pills or the like into the controlled liquid flow from the drinking container. The foregoing abstract is merely a resume of one general application, is not a complete discussion of all principles of operation or applications, and is not to be construed as a limitation on the scope of the claimed subject matter.

1 Claim, 11 Drawing Figures

FIG. 1
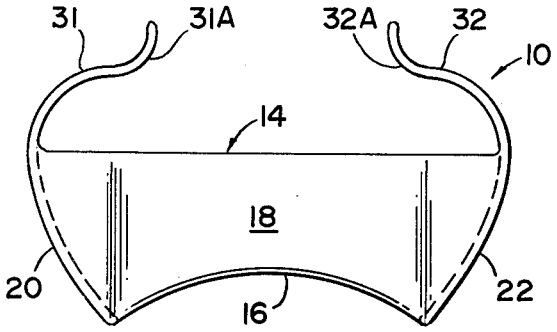
FIG. 2
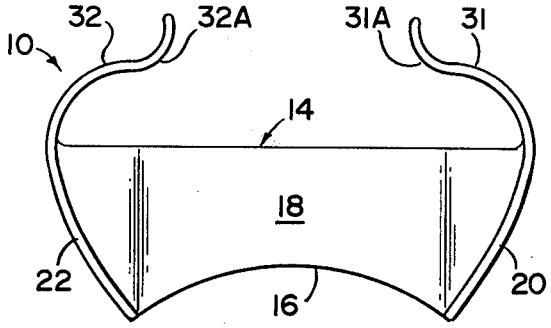
FIG. 3
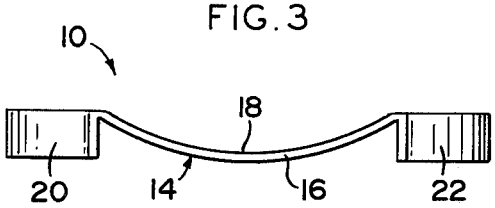
FIG. 4
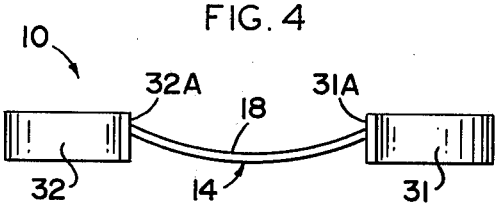
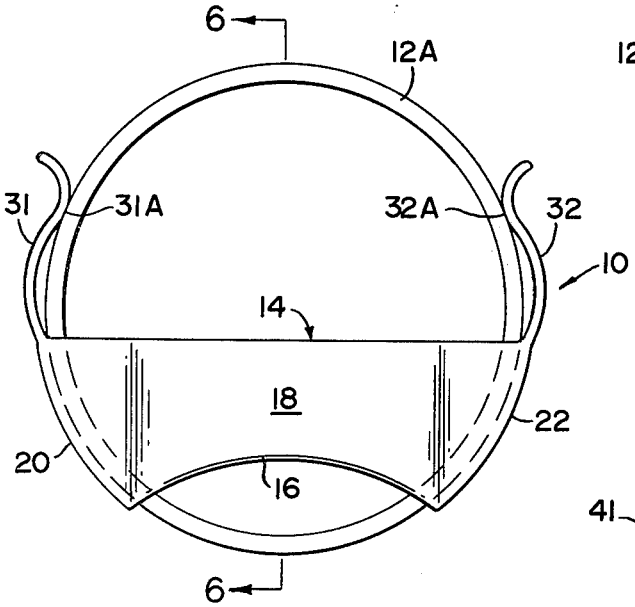
FIG. 5
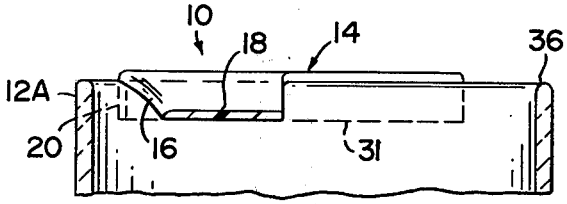
FIG. 6
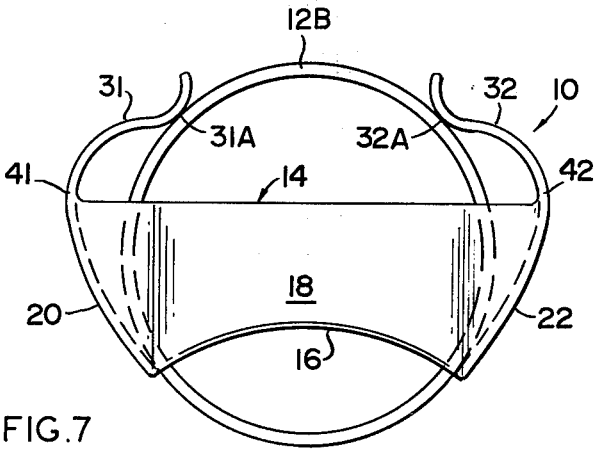
FIG. 7

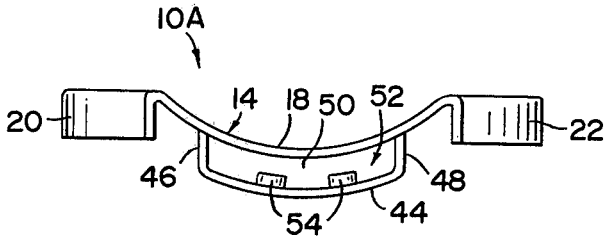
FIG. 8
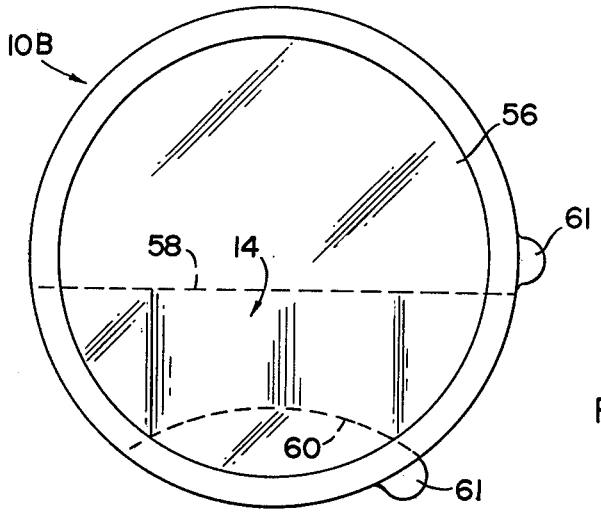
FIG. 10
FIG. 11
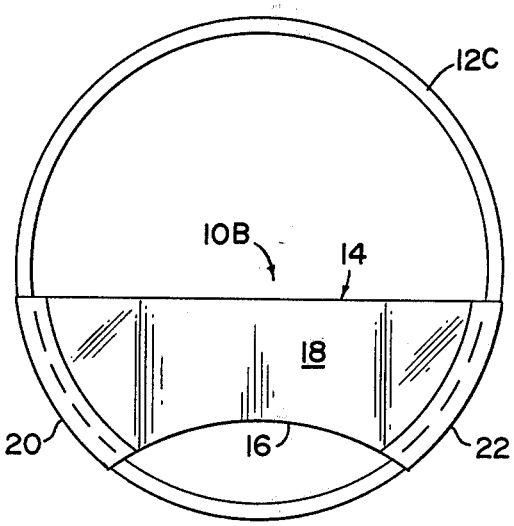
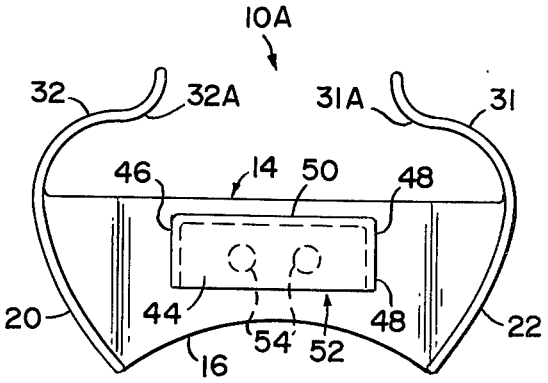
FIG. 9

PROTECTIVE DEVICE

BACKGROUND OF THE INVENTION

1. Field of the Invention

This invention relates to protective devices and more particularly to devices for protecting the mouth region of a person while drinking from a liquid container.

2. Description of the Prior Art

Various types of devices have been known in the prior art for protecting a person while drinking. Some of these devices were known as moustache guards or protective devices and were popular during the turn of this century due to the popularity of moustaches. Thereafter, moustaches became less popular and accordingly many of these devices were forgotton and seldom seen or used.

In recent years, moustaches have again become popular and again a need arises for a protective device for protecting the moustache of a person while drinking. Other persons object to the contact of ice while drinking. Accordingly, there is a present need in the art for a protective device for use with a drinking container.

Unfortunately, the design, construction and manufacture of the moustache guard that was popular during the turn of the century are no longer feasible today. Most of these devices were overly complex, expensive and were not at all suitable for disposable use.

Therefore it is an object of this invention to provide an apparatus which overcomes the aforementioned inadequacies of the prior art devices and provides an improvement which is a significant contribution to the advancement of the protective art.

Another object of this invention is to provide a protective device for use with a drinking container made of an integral plastic structure with tabs extending from opposed sides of a shield and resilient means established relative to the shield for resiliently grasping the outer circumference of the drinking container.

Another object of this invention is to provide a protective device for use with a drinking container wherein the resilient means includes a first and a second arm being resilient within limited excursions of deformation while simutaneously being deformable when subjected to excursions beyond the limited excursions for adjusting the first and second arms for grasping various sizes of containers.

Another object of this invention is to provide a protective device for use with a drinking container wherein the device is a portion of a complete cover of a liquid container with means such as perforations or a weakening in the material of the complete cover defining the device from the remainder of the complete cover.

Another object of this invention is to provide a protective device for use with a drinking container including a cartridge for introducing a substance into the control liquid flow from the drinking container.

Another object of this invention is to provide a protective device for use with a drinking container which may be formed of a single molded plastic material at a low cost making the device a deposable item.

Another object of this invention is to provide a protective device for use with a drinking container wherein the protective device is suitable for receiving a trademark whereby the device may be used as an advertising medium.

Other objects and a fuller understanding of this invention may be had by referring to the summary of the invention, the description and the claims, taken in conjunction with the accompanying drawings.

SUMMARY OF THE INVENTION

The invention may be incorporated into a protective device for use with a drinking container such as a drinking glass, paper or glass cup. The device includes a shield having an aperture therein with tabs extending from opposed sides of the shield. The tabs are established for contacting portions of the outer circumference of the drinking container when the shield is positioned over the opening in the drinking container. The aperture means provides controlled liquid flow from the drinking container. Resilient means established relative to the shield resiliently grasp the outer circumference of the drinking container to retain the shield over the opening of the drinking container.

More specifically, the tabs are integral with the shield and extend substantially perpendicularly from the sides of the shield. The aperture means may include a cut out region in one side of the shield for forming an aperture with the outer circumference of the container. The shield may also include a curved region established between the opposed sides of the shield being capable of receiving a trademark of a product for advertising purposes.

An important aspect of one of the invention includes the resilient means comprising a first and a second arm extending from the tabs for resiliently grasping the drinking container between the tabs and the arms. The device may be integrally formed of a plastic material such that the first and second arms are resilient within limited excusions of deformation. The first and second arms may be deformed when subjected to excursions beyond the limited excursion. Accordingly, the first and second arms may be adjusted to resiliently grasp liquid containers of various sizes. In this embodiment, the tabs, the resilient means are integral with the shield.

In another embodiment of the invention, the device is a portion of a complete cover for a container. The complete cover may be fashioned from a conventional plastic cap cooperable with a paper or plastic cup as well known in the art. Defining means including a weakening or a perforation in the material of the cover define the device from the remainder of the complete cover. Accordingly, the consumer may tear along the weakenings or perforations in the complete cover thereby creating the device for use while drinking.

In still another embodiment of the invention, the device may include a cartridge established relative to the shield for introducing a substance such as a pill and the like into the control liquid flow of drinking container.

This invention accordingly comprises an article possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a top elevational view of the preferred embodiment of the invention;

FIG. 2 is a bottom elevational view of the invention shown in FIG. 1;

FIG. 3 is a front elevational view of the invention shown in FIG. 1;

FIG. 4 is a rear elevational view of the invention shown in FIGS. 1–3;

FIG. 5 is a top elevational view of the invention shown in FIGS. 1–4 resiliently mounted to a large drinking container;

FIG. 6 is a sectional view taken along line 6—6 in FIG. 5 showing the device mounted to the drinking container;

FIG. 7 is a top elevational view of the invention shown in FIGS. 1–6 mounted on a small drinking container;

FIG. 8 is a front elevational view of a second embodiment of the invention showing a protective device incorporating a cartridge;

FIG. 9 is a bottom view of the invention shown in FIG. 8;

FIG. 10 is a third embodiment of the invention wherein the device forms a portion of a complete cover for a drinking container and FIG. 11 is a top elevational view of the device shown in FIG. 10 mounted to a drinking glass.

Similar reference characters refer to similar parts throughout the several view of the drawings.

DETAILED DESCRIPTION

FIGS. 1–7 illustrate a first embodiment of a protective device 10 for use with a drinking container 12 shown as a large container 12A in FIGS. 5 and 6 and a small container 12B in FIG. 7. The device 10 comprises a shield 14 having aperture means 16 shown as a cut out region. The shield 14 has a central curved region 18 which is suitable for receiving indicia such as advertising, a trademark, slogans and the like. It should be appreciated that the indica may be applied to the curved region 18 by one of many means well known to the art.

Tabs 20 and 22 extend substantially perpendicularly from opposed partially circular ends of shield 14 defining opposed chordal sections of a circle. The tabs 20 and 22 are integrally formed with the shield 14. Resilient means shown as a first and a second resilient arm 31 and 32 are integral with the shield 14 and extend from tabs 20 and 22 respectively. The arms 31 and 32 have contact surfaces 31A and 32A for contacting the drinking container as will be hereinafter described.

FIGS. 5 and 6 illustrates the device 10 mounted on a large diameter drinking container 12A. In this embodiment, the tabs 20 and 22 contact portions of the outer circumference of the drinking container 12A. The contact surfaces 31A and 32A of the first and second arms 31 and 32 resiliently grasp the outer circumference of the drinking container 12A to retain the shield 14 over the opening in the container 12A. The curved region 18 extends below the top surface 36 of the container 12A for minimal interference with the drinking process.

FIG. 7 illustrates the same device 10 being secured to a small diameter drinking container 12B. The material used to fabricate the device 10 is resilient within its elastic limits within a small or limited excursion of deformation. Upon exceeding the elastic limit, the material becomes deformable and will retain a new deformed shape. The material will also be resilient at the new deformed shape as long as the deformation is again held within limited excursions. Accordingly, this property enables the device 10 to be secured to the small container 12B as shown in FIG. 7. In this embodiment, the arms 31 and 32 are bent beyond the elastic limits causing permanent deformation at points 41 for enabling the contact portions 31A and 32A to resiliently grasp the outer circumference of the container 12B. The tabs 20 and 22 engage the outer circumference of the glass 12B. The device 10 shown in FIG. 7 may again be deformed and replaced on the large container 12A shown in FIG. 5. Although the device is primarily designed to be disposable, the device may be used on various size glasses before permanent damage is caused at points 41 and 42. A material such as has been found suitable for use in this invention but it is understood that any material having these properties may be used in the invention.

FIGS. 8 and 9 show front and bottom views of a second embodiment of a device 10A including a cartridge 44 having side walls 46 and 48 and a rear wall 50. The cartridge 44 has an open front 52 for containing a substance for example, a plurality of pills 54. The cartridge 44 enables introduction of the substance into the control liquid flow from the drinking container through aperture or cut out 16 while drinking.

FIGS. 10 and 11 show a third embodiment 10B of the invention. In this embodiment, a conventional plastic complete cover 56 has means shown as perforation 58 and 60 defining the device 10B. A liquid product may be sold in a paper or plastic cup with the complete cover 56 containing the liquid therein. The consumer may tear along perforations 58 and 60 creating the device 10B. Optional tabs 61 may be included for aiding the consumer to tear the material along perforations 58 and 60. The device 10B is then inserted on the paper container 12C as shown in FIG. 11 with the tabs 22 being resiliently mounting the shield 14 to the container 12C.

The invention has been described as a novel means for providing protection to a person while drinking from a liquid container. The invention may include a unitary plastic device having the claimed properties with the three species specifically setting forth three advantages of the invention. It should be understood that each of the advantages may be interchanged with one another and that numerous variations are adaptable for this invention.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

What is claimed is:

1. An integral protective device for use with a drinking container having a circular opening surrounded by a drinking rim, the device comprising in combination:

a substantially horizontal shield for shielding a portion of the top opening in the drinking container;

said shield having two side edges that traverse across portions of said opening; said side edges bounded by two arcuate end edges defining opposing chrdal sections of a circle;

a first and a second partially circular tab integrally extending downwardly from said end edges;

said first and second tabs contacting portions of the circular drinking rim of the drinking container when said shield is positioned over the opening in the drinking container;

an aperture means comprising a cut out region extending through said shield and located adjacent said first and second tab for providing controlled liquid flow through said aperture means;

a first and a second arm respectively extending laterally from said first and second tabs and extending about portions of the circumferential lateral surface of the drinking container; each of said first and second arms having a first inwardly arcuate contour immediately adjacent said first and second tabs respectively;

said first contour being curved in the direction of curvature of the circumferential lateral surface of the drinking container;

each of said first and second arms having a second contour;

said second contour being curved in a direction opposite to the direction of curvature of the circumferential lateral surface of the drinking container and defining first and second arm contact portions;

resilient means integrally established between each of said first and second tabs and said first and second arms for resiliently grasping the circumferential lateral surface of the drinking container with said first and second tabs and said first and second arm contact portions; and said first and second arms being resiliently deformable for adjusting said first and second arms to resiliently grasp liquid containers of various sizes with said first and second arm contact portions.

* * * * *